United States Patent [19]

Surinak

[11] Patent Number: 4,886,426

[45] Date of Patent: Dec. 12, 1989

[54] SUBMERGIBLE PUMP CONNECTING EJECTOR ADAPTER AND GUIDE RAIL ASSEMBLY

[76] Inventor: John J. Surinak, 2 Earling Ct., Oconomowoc, Wis. 53066

[21] Appl. No.: 349,872

[22] Filed: May 9, 1989

Related U.S. Application Data

[63] Continuation of Ser. No. 148,018, Jan. 25, 1988, abandoned.

[51] Int. Cl.[4] ..... E04B 17/00; E04B 35/00

[52] U.S. Cl. ..... 417/360; 417/361; 285/24; 285/325

[58] Field of Search ..... 417/360, 361; 415/126; 285/24, 27, 325; 222/385

[56] References Cited

U.S. PATENT DOCUMENTS

| | | | |
|---|---|---|---|
| 2,689,611 | 9/1954 | Martinson | 166/88 |
| 3,467,181 | 4/1969 | Maass | 166/85 |
| 3,645,333 | 2/1972 | Maass | 166/85 |
| 3,938,545 | 2/1976 | Nagy et al. | 417/360 |
| 4,308,000 | 12/1981 | Oakes | 417/360 |
| 4,392,790 | 7/1983 | Shibata et al. | 417/360 |
| 4,564,041 | 1/1987 | Kramer | 417/360 |
| 4,726,742 | 2/1988 | Harbison et al. | 417/360 |

FOREIGN PATENT DOCUMENTS

| | | | |
|---|---|---|---|
| 246575 | 4/1966 | Austria | 417/360 |
| 2139654 | 2/1973 | Fed. Rep. of Germany | 417/361 |
| 658055 | 6/1929 | France . | |

OTHER PUBLICATIONS

Advertising Leaflet entitled "Maass Model JS Adapters" published by Surinak Engineering & Manufacturing, Inc. on or about 12-1-84.

*Primary Examiner*—Donald E. Stout

*Attorney, Agent, or Firm*—Andrus, Sceales, Starke & Sawall

[57] ABSTRACT

An ejector adapter and guide rail assembly for coupling an opening of a discharge outlet of a submergible pump with an inlet opening of a discharge pipe through which waste water is discharged from a sump. The assembly includes a quick disconnect coupling device having a bifurcated guide member which engages a vertical guide rail to permit removal and reinstallation of the submergible pump without removal of a bracket that fixedly mounts the upper end of the guide rail to the sump.

4 Claims, 2 Drawing Sheets

FIG. 3
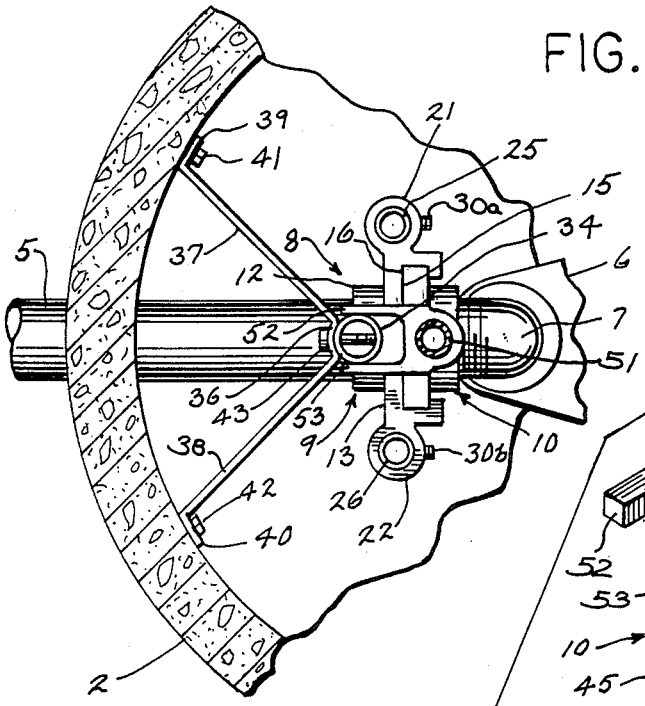
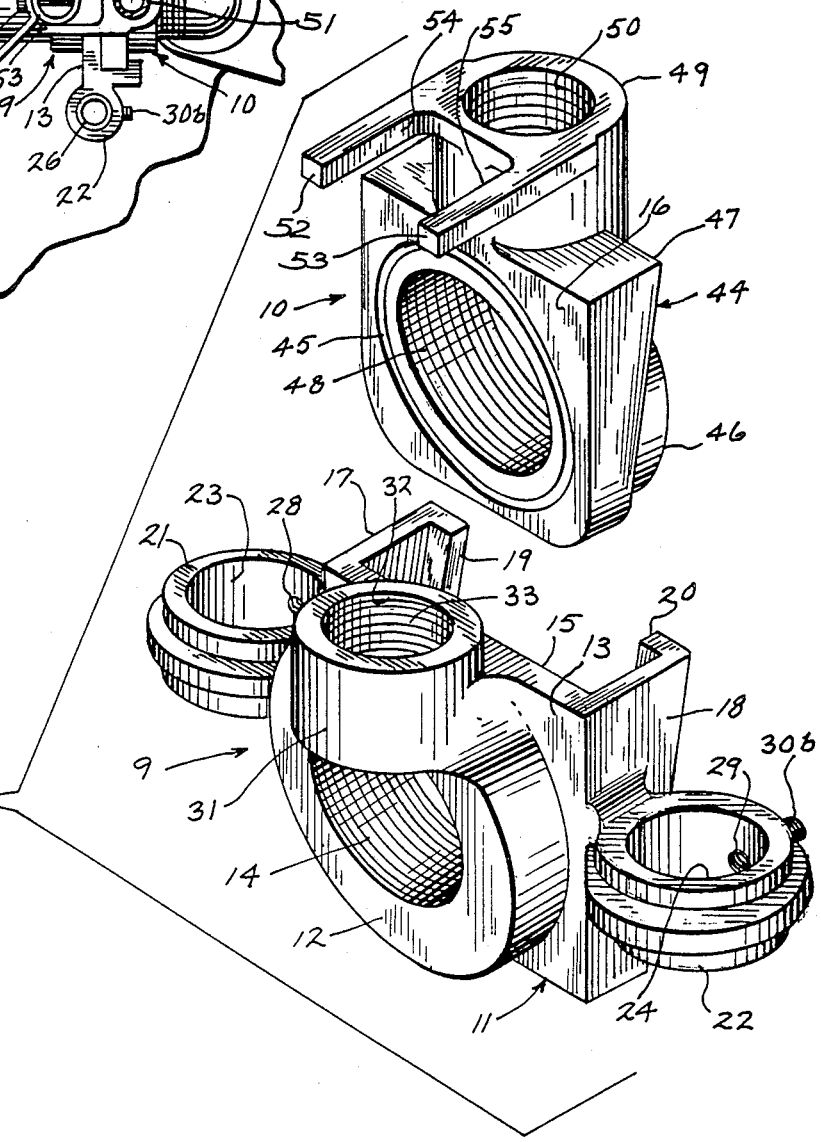
FIG. 4

SUBMERGIBLE PUMP CONNECTING EJECTOR ADAPTER AND GUIDE RAIL ASSEMBLY

This application is a continuation of copending application Ser. No. 148,018, filed Jan. 25, 1988, now abandoned.

BACKGROUND OF THE INVENTION

The present invention relates to pumping systems for sump or sewage pits and basins, and more particularly to a connecting ejector adapter and guide rail assembly for submergible ejector pumps used in such systems.

The pumping system utilized in sump or sewage pits and basins must be so constructed that the submerged pump may be removable for maintenance and repair. Therefore, the pumping systems must make a provision for connecting and disconnecting the submergible pumps from the associated discharge outlet from the pit or effluent tank as well as for guiding the pump as it is raised and lowered to permit easy removal and reinstallation of the pump.

Various coupling devices and guide rail assemblies for submergible pumps are known in the art, and are shown in U.S. Pat. Nos. 4,564,041, 4,308,000, 3,645,333, 3,467,181 and 2,689,611 as well as in French Patent No. 658,055. In the above patents, however, the guide rails are either unsupported at their upper ends, or, if supported by a bracket, the bracket must be removed prior to the complete removal of the pump from the guide rail and sump. Often times, such a bracket is difficult to remove from the guide rail due to the corrosive environment in which it is utilized.

It is therefore desirable to provide a guide rail assembly which utilizes a bracket for supporting the upper end of the guide rail which bracket need not be removed in order to permit removal of the pump from the pit or basin.

SUMMARY OF THE INVENTION

An ejector adapter and guide rail assembly for coupling an opening of a discharge outlet of a submergible pump with an opening of a discharge pipe through which waste water is discharged from a sump.

The ejector adapter and guide rail assembly includes a first coupling member fixedly mounted at the inlet opening of the discharge pipe, a second coupling member fixedly mounted at the outlet opening of the submergible pump, coupling means on one of the coupling members for cooperation with the other coupling member to permit selective coupling and uncoupling of the pump outlet and discharge pipe during vertical movement of the pump with respect to the discharge pipe so that the openings thereof are in registering relation with each other when the coupling members are in coupled relation and are in nonregistering relation with each other when the coupling members are in uncoupled relation, a vertical guide rail having a lower end connected to the first coupling member and an upper end extending vertically upwardly from the first coupling member, bracket means for fixedly mounting the upper end of the guide rail to the sump, guide means on the second coupling member for engaging the guide rail to guide the second coupling member, discharge outlet and pump along the guide rail during vertical movement thereof past the bracket means for removal thereof from the sump without removal of the bracket means from the sump, and lift means connected to the second coupling member for raising and lowering the submergible pump on the guide rail for selective coupling and uncoupling of the pump discharge outlet and discharge pipe.

In one aspect of the invention, the guide means comprises a bifurcated member having a pair of spaced rail-engaging elements disposed parallel to and substantially horizontal to each other which is integral with the second coupling member. The guide means may also comprise other non-encircling rail-engaging members so long as it permits removal of the pump along the guide rail without removal of the bracket means.

The present invention thus provides an ejector adapter and guide rail assembly which permits easy removal and reinstallation of a submergible pump from a sewage and effluent installation.

BRIEF DESCRIPTION OF THE DRAWINGS

The drawings illustrate the best mode presently contemplated of carrying out the invention.

In the drawings:

FIG. 3 is a fragmentary top plan view of the well installation of FIG. 1; and FIG. 4 is an exploded perspective view of the ejector adapter.

DESCRIPTION OF THE PREFERRED EMBODIMENT

Figure 1:
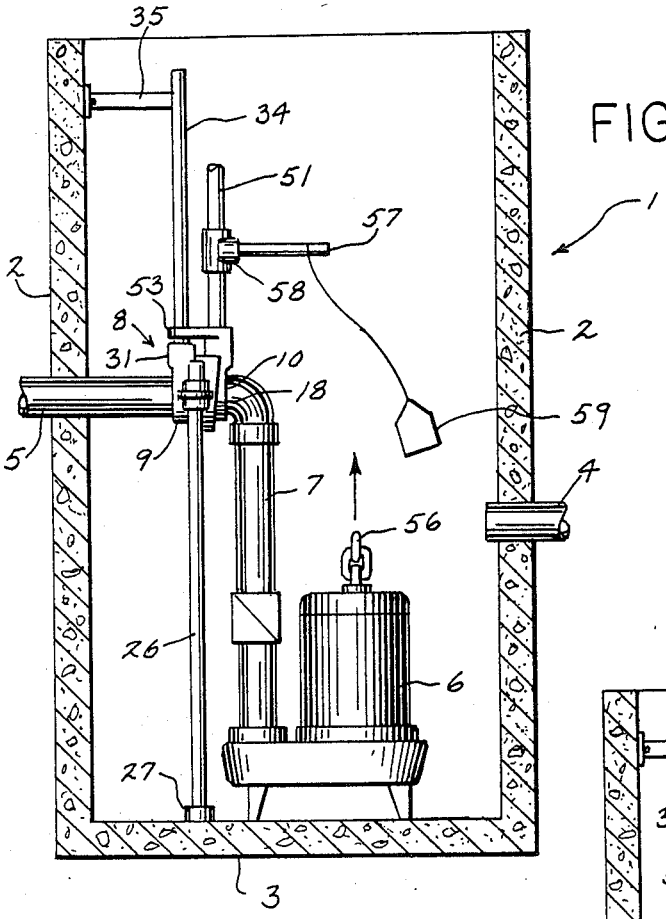
FIG. 1 is a side view in elevation of a sump installation having a submergible pump which includes an ejector adapter and guide rail assembly in accordance with the present invention shown in its coupled relation and the pump in its lowered position.
Figure 2:
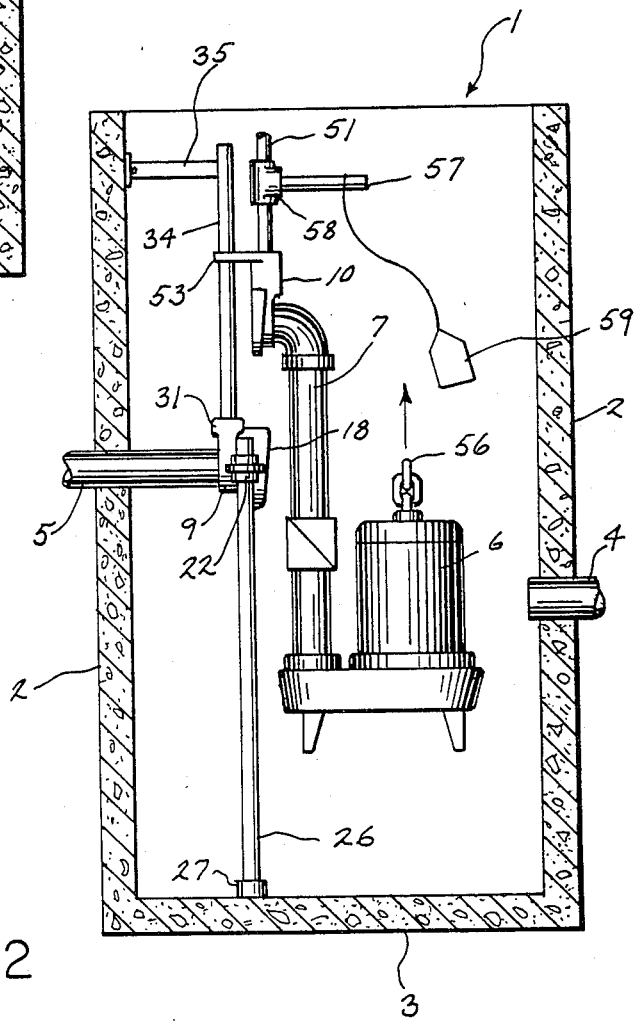
FIG. 2 is a side view in elevation similar to FIG. 1 showing the adapter and guide rail assembly in its uncoupled relation and the pump in a raised position.

Referring now to the drawings, FIGS. 1 and 2 illustrate a sewage installation or sump 1 of the type which is typically utilized, for example, for sewage, waste and sump pump installations. Sump 1 may be of a generally rectangular or cylindrical configuration and includes opposed vertical side walls 2 and a bottom wall 3 formed of masonry, which is of the type typically used in residences and in some commercial establishments. Effluent or waste water typically containing entrained solids is introduced into sump 1 by means of an inlet pipe 4 passing through side wall 2. The waste water is discharged from the interior of sump 1 through a discharge pipe 5 passing through side wall 2 opposite of inlet pipe 4 by means of a submergible pump 6.

Submergible pump 6 is provided with an inlet or intake through which waste water is drawn, and a discharge outlet 7 through which waste water is pumped to discharge pipe 5. The opening of discharge outlet 7 of pump 6 is connected or coupled to the inlet opening of discharge pipe 5 by means of an ejector adapter quick disconnect coupling device 8.

As shown best in FIGS. 3 and 4, adapter 8 includes a pair of interconnecting coupling members 9, 10 which permits selective coupling and uncoupling of the pump discharge outlet 7 and discharge pipe 5 during vertical movement of the outlet 7 and pump 6 with respect to discharge pipe 5. Coupling members 9, 10 may be composed of any suitable noncorrosive material such as a chemically inert plastic material like polyvinyl chloride, stainless steel, or a corrosive resistant brass alloy.

Referring to FIG. 4, coupling member 9 includes a body 11 having a generally cylindrical sleeve 12 integrally formed therewith and projecting outwardly from front surface 13 of body 11. Sleeve 12 is internally threaded, as at 14, to provide a threaded connection to the threaded end of discharge pipe 5. Rear surface 15 of body 11 defines a planar coupling face for engagement with a mating coupling face 16 on coupling member 10. A pair of spaced, parallel flanges 17, 18 are integral with body 11 of coupling member 9 and project rearwardly from surface 15 along opposite edges thereof. Each flange 17, 18 has an inturned terminal flange portion 19, 20, respectively, integral therewith and projecting inwardly therefrom. Inturned terminal flanges 19, 20 are disposed in substantially parallel relation with respect to rear surface 15 of body 11. Body 11 and flanges 17–20 form a wedge shaped coupling chamber which is both wider and longer at its top edge than at its bottom edge for receiving coupling member 10, as will hereinafter be described.

Each flange 17, 18 has a cylindrical collar 21, 22, respectively, which is integral therewith and projecting horizontally outwardly therefrom. Each collar 21, 22 is annular in shape and defines an opening 23, 24, respectively, for slidably receiving one of a pair of stand pipes 25, 26. Stand pipes 25, 26 are mounted at their lower ends (see FIGS. 1 and 2) in a support foot 27 which in turn is mounted to bottom wall 3 of sump 1. Stand pipes 25, 26 extend vertically upwardly from foot 27 with their respective upper ends slidably received within openings 23, 24 of collars 21, 22 of coupling member 9. Each collar 21, 22 is provided with an internally threaded bore 28, 29, respectively, which accommodates a set screw **30*a* or 30*b* which may be tightened into engaging relation with stand pipes 25, 26. This arrangement permits coupling member 9 to be selectively vertically positioned on stand pipes 25, 26 at the appropriate height so that threads 14 of sleeve 12 of coupling member 9 may provide a threaded connection to the threaded inlet opening end of discharge pipe 5**.

Body 11 of coupling member 9 also includes a cylindrical support stack 31 integral therewith and projecting upwardly from sleeve 12. Stack 31 includes a blind opening 32 with internal threads 33 for a threaded connection to the threaded lower end of a vertically extending guide rail 34, as best shown in FIGS. 1 and 2. Guide rail 34 is in the form of a tubular member or pipe extending vertically upwardly from stack 31 and includes an upper end fixedly connected to side wall 2 of sump 1 by means of a bracket 35. As shown best in FIG. 3, bracket 35 includes an arcuate guide rail-engaging portion 36 together with a pair of arms 37, 38 diverging from opposite edges of portion 36. Arms 37, 38 terminate in outwardly turned flanges 39, 40, respectively, which engage the inner surface of side wall 2 of sump 1. Arms 37, 38 are mounted to side wall 2 of sump 1 by means of a pair of bolts 41, 42 extending through flanges 39, 40, respectively, and is mounted to the upper end of guide rail 34 by a bolt 43 which extends through arcuate portion 36 into guide rail 34. Bracket 35 may alternately be welded at portion 36 to guide rail 34. During assembly, arms 37, 38 may be moved or bent inwardly toward each other or outwardly away from each other so as to adjust the distance or space between the inner surface of side wall 2 and the upper end of guide rail 34. This adjustability functions to accommodate the distance of adapter 8 from side wall 2 on discharge pipe 5 which may vary slightly from installation to installation.

Referring once again to FIG. 4, coupling member 10 includes a wedge shaped body 44 having a rubber seal or O-ring 45 embedded within coupling face 16 to provide sealing engagement with rear surface 15 of body 11 of coupling member 9 when coupling members 9 and 10 are in coupled relation. Body 44 includes a generally cylindrical sleeve 46 projecting outwardly from rear surface 47 integrally formed therewith. Sleeve 44 is internally threaded, as at 48, for a threaded connection to the threaded end of discharge outlet 7 of pump 6. The wedge shape of body 44 substantially conforms to the wedge shaped coupling chamber formed in body 11 of coupling member 9 so as to fit snugly therein to permit discharge of waste water from outlet 7 of pump 6 through discharge pipe 5 during operation of pump 6.

Body 44 of coupling member 10 also includes a cylindrical upstanding stack 49 integral with body 44 and projecting upwardly therefrom. Stack 49 includes an internally threaded blind opening 50 for threaded connection to the threaded lower end of a lift pipe 51. As shown best in FIGS. 1 and 2, lift pipe 51 projects upwardly from coupling member 10 substantially parallel to guide rail 34. Stack 49 also includes a bifurcated member having a pair of spaced rail-engaging fingers 52, 53 projecting horizontally therefrom in a cantilevered fashion. The space between fingers 52, 53 is dimensioned such that fingers 52, 53 straddle opposite sides of guide rail 34 and provide sliding engagement between inner surfaces 54, 55 of fingers 52, 53, respectively, and the outer surface of guide rail 34. As seen best in FIG. 3, the length of fingers 52, 53 is dimensioned so that coupling member 10 as well as pump 6 may be vertically removed along guide rail 34 from sump 1 without removal of bracket 35 from sump 1.

As seen best in FIGS. 1 and 2, a lift chain 56 is also connected to pump 6 in order to aid in removing pump 6 from sump 1. Additionally, a short pipe 57 is connected to lift pipe 51 by a fitting 58 and projects perpendicular thereto. Float controls 59 are connected to pipe 57 and operate to automatically turn on or shut off pump 6 depending upon the height of waste water in sump 1 in the conventional manner.

In operation, coupling members 9, 10 will be disposed in coupling relation as shown in FIG. 1 so that the respective openings of discharge outlet 7 and discharge pipe 5 are in registering relation with each other. Fingers 52, 53 straddle opposite sides of guide rail 34 as shown best in FIG. 3 with the body 44 of coupling member 10 disposed within the coupling chamber of coupling member 9 so that O-ring 45 on coupling face 16 will sealingly engage the rear surface 15 of coupling member 9. An effective fluid seal is thus formed by O-ring 45 so that waste water may be discharged by pump 6 through discharge outlet 7 and discharge pipe 5.

Coupling member 10 may be uncoupled from coupling member 9 by raising pump 6, discharge outlet 7 and coupling member 10 by means of lift chain 56 and/or lift pipe 51. Thus, in the event that pump 6 fails or must be removed for maintenance, a user merely pulls on pipe 51 and/or chain 56 to cause coupling member 10 to be moved vertically along guide rail 34. The vertical movement is guided by means of fingers 52, 53 so that pump 6 may be readily removed from sump 1. There is no need to remove bracket 35 as fingers 52, 53 readily slide past arms 37, 38.

After pump 6 is repaired or replaced, it is then necessary to recouple discharge outlet 7 to discharge pipe 5. To accomplish this, coupling member 10 is positioned so that fingers 52, 53 straddle guide rail 34, and the user then lowers pump 6 along guide rail 34 until body 44 of coupling member 10 engages body 11 of coupling member 9. It is particularly advantageous that both the removal and replacement of pump 6 may occur without removal or disassembly of bracket 35 which fixedly mounts the upper end of guide rail 34 to the top of sump 1.

The present invention thus provides an ejector adapter and guide rail assembly for coupling an opening of a discharge outlet of a submergible pump with an inlet opening of a discharge pipe through which waste water is discharged from a sump which is readily removable and replaceable by a user with a minimum of effort by merely raising and lowering the submergible pump.

Various modes of carrying out the invention are contemplated as being within the scope of the following claims particularly pointing out and distinctly claiming the subject matter which is regarded as the invention.

I claim:

1. An ejector adapter and guide rail assembly for coupling an opening of a discharge outlet of a submergible pump with an inlet opening of a discharge pipe through with waste water is discharged from a sump, comprising:

a first coupling member fixedly mounted at the inlet opening of said discharge pipe;

a second coupling member fixedly mounted at the outlet opening of said submergible pump;

coupling means on one of said coupling members for cooperation with the other of said coupling members to permit selective coupling and uncoupling of said discharge outlet and discharge pipe during vertical movement of said discharge outlet and pump with respect to said discharge pipe so that the openings thereof are in registering relating with each other when said coupling members are in coupled relation and are in non-registering relation with each other when said coupling members are in uncoupled relation;

a vertical guide rail having a lower end connected to said first coupling member and an upper end extending vertically upwardly from said first coupling member, said guide rail defining a vertical longitudinal axis and comprising a tubular shaped member having a pair of oppositely disposed arcuate shaped peripheral surfaces;

guide means on said second coupling member for engaging said guide rail to guide said second coupling member, discharge outlet and pump along said guide rail during vertical movement thereof for removal thereof from said sump, said guides means comprises a non-encircling rail-engaging member including a bifurcated member having a pair of spaced elongated rail-engaging elements each having an inner surface disposed on opposite sides of said guide rail to tangentially engage said arcuate shaped peripheral surfaces of said guide rail to provide only two axially sliding line contacts therewith during vertical movement on said guide rail, and said rail-engaging elements extend substantially horizontally to permit movement of said second coupling member longitudinally with respect to said rail-engaging elements and spaced laterally from one another a sufficient distance to permit said vertical sliding movement but to prevent any substantial lateral movement of said second coupling member with respect to said rail-engaging elements; and lift means connected to said second coupling member for raising and lowering said submergible pump on said guide rail for selective coupling and uncoupling of said discharge outlet and discharge pipe.

2. The assembly of claim 1 wherein said rail-engaging elements are disposed parallel to and substantially horizontal to each other.

3. The assembly of claim 1 wherein said bifurcated member is integral with said second coupling member.

4. The assembly of claim 1 further including bracket means for fixedly mounting the upper end of said guide rail to said sump, and said rail-engaging elements dimensioned to permit vertical movement past said bracket means without removal of said bracket means from the sump.

* * * * *

UNITED STATES PATENT AND TRADEMARK OFFICE

CERTIFICATE OF CORRECTION

PATENT NO. : 4,886,426

DATED : December 12, 1989

INVENTOR(S) : John J. Surinak

It is certified that error appears in the above-identified patent and that said Letters Patent is hereby corrected as shown below:

Claim 1, Col. 5, Line 23, after "through" delete "with", and substitute therefore --- which ---; Claim 1, Col. 5, Line 35, after "registering" delete "relating" and substitute therefore --- relation ---; Claim 1, Col. 6, Line 9, after "said", delete "guides", and substitute therefore --- guide ---.

Signed and Sealed this

Second Day of April, 1991

*Attest:*

HARRY F. MANBECK, JR.

*Attesting Officer*

*Commissioner of Patents and Trademarks*